US005555074A

United States Patent [19]

Haragakiuchi et al.

[11] Patent Number: 5,555,074

[45] Date of Patent: Sep. 10, 1996

[54] ELECTROPHOTOGRAPHIC APPARATUS AND ELECTROPHOTOGRAPHIC METHOD

[75] Inventors: Hideyuki Haragakiuchi; Hiroyuki Tadokoro; Nobuaki Fukasawa; Isamu Terashima; Akira Sasaki; Kazuyoshi Matsuo; Katuyoshi Onose; Masashi Okuhama, all of Hitachi, Japan

[73] Assignee: Hitachi, Ltd., Tokyo, Japan

[21] Appl. No.: 370,707

[22] Filed: Jan. 10, 1995

[30] Foreign Application Priority Data

Jan. 13, 1994 [JP] Japan ..... 6-001934
Feb. 10, 1994 [JP] Japan ..... 6-016083

[51] Int. Cl.[6] ..... G03G 15/20; G03G 21/00

[52] U.S. Cl. ..... 355/208; 355/285; 355/289; 219/216

[58] Field of Search ..... 355/208, 282, 355/285, 289, 290, 295, 326 R; 219/216

[56] References Cited

U.S. PATENT DOCUMENTS

| | | | |
|---|---|---|---|
| 4,373,801 | 2/1983 | Itoh | 219/216 X |
| 4,425,494 | 1/1984 | Enomoto et al. | 219/216 |
| 4,719,489 | 1/1988 | Ohkubo et al. | 219/216 X |
| 4,878,092 | 10/1989 | Arai | 219/216 X |
| 4,901,110 | 2/1990 | Tompkins et al. | 355/326 R |
| 4,968,872 | 11/1990 | Kusumoto | 355/290 X |
| 5,049,906 | 9/1991 | Kobayashi et al. | 355/208 X |
| 5,081,493 | 1/1992 | Miyasaka | 355/208 |
| 5,241,349 | 8/1993 | Nagasaka | 355/285 |
| 5,276,482 | 1/1994 | Nakanishi | 355/208 |
| 5,319,428 | 6/1994 | Maruko et al. | 355/290 |
| 5,321,479 | 6/1994 | Yoshida et al. | 355/285 |
| 5,361,124 | 11/1994 | Rowe et al. | 355/208 |

*Primary Examiner*—Matthew S. Smith
*Attorney, Agent, or Firm*—Kenyon & Kenyon

[57] ABSTRACT

The disclosure is concerned with an electrophotographic apparatus comprising a toner image supporting member on which a toner image developed on an electrostatic latent image is formed, transferring means for transferring the toner image on said toner image supporting member to a recording medium, conveying means for bringing the recording medium into contact with the image supporting member, a fixing roller and a compression roller in contact with each other to fix the toner image on the recording medium, heating means disposed inside at least one of the fixing roller and the compression roller, wherein there are provided temperature detection means for detecting the surface temperature of the fixing roller and state detection means for detecting the state of the fixing apparatus before starting of the fixing apparatus.

9 Claims, 13 Drawing Sheets

| LAP TIME TO FIRST TEMPERATURE CONTROL POINT (S) | LEVEL CONTROL POINT | KINDS START |
|---|---|---|
| $t_0 \sim t_1$ | FIRST SETTING TEMPERATURE | HOT START |
| $t_1 + 1 \sim t_2$ | SECOND SETTING TEMPERATURE | MIDDLE H START |
| $t_2 + 1 \sim t_3$ | THIRD SETTING TEMPERATURE | MIDDLE L START |
| $t_3 + 1 \sim$ | FOURTH SETTING TEMPERATURE | COLD START |

ELECTROPHOTOGRAPHIC APPARATUS AND ELECTROPHOTOGRAPHIC METHOD

BACKGROUND

This invention relates to an electrophotographic apparatus, such as printers including laser printers and electrophotographic copiers, and particularly, relates to an electrophotographic apparatus having a device for fixing a toner image with stability on a recording medium and an electrophotographic method.

In a conventional electrophotographic apparatus, as shown in Japanese patent Laid-open print No. 57-828773, etc., a fixing apparatus is formed as a duplex cylinder in which an outer portion is formed of a material with a large modulus of elasticity and an inner portion is formed of a material with a higher heat conductivity than, the outer portion, and a heating roller having a heater near the central axis thereof and a compression roller to pressurize the recording medium against the heating roller, and fixes a toner image on the recording medium by passing it between the rollers.

Japanese patent Laid-open print No. 4-178679 discloses a method of determining the temperature at the time of fixing by detecting an increased temperature of the heating component when a main power of the fixing roller is on.

Japanese patent Laid-open print No. 2-161481 discloses an apparatus wherein a heating temperature is changed according to an output of a temperature sensor.

Japanese patent Laid-open print No. 63-172187 discloses an apparatus wherein temperature modes are set in advance and the temperature control modes are changed over time with a prescribed temperature.

Japanese patent Laid-open print No. 5-281875 discloses an apparatus wherein a fixing temperature is changed according to the kind of recording paper and whether color printing or black-and-white printing is specified by a person. The fixing equipment uses a rubber material with low heat conductivity for the roller surface. Therefore, a time delay occurs until heat given by the heating means arrives at the roller surface. When a recording medium passes between the rollers of the fixing device, the temperature of the roller surface drops rapidly. When the temperature drop of the roller surface is detected, and when the heating means is turned on to provide heat, the roller surface temperature decreases gradually because of the time delay mentioned above. When the heat detection means detects the specified control temperature, and when the heating means is turned off, the temperature on the roller surface becomes too high (i.e. overshoot) because the quantity of heat released has been excessive.

Particularly, at the time of starting up the fixing device or at the time of the start of the first page from the waiting state, the temperature change of the fixing device is large until the temperature becomes stable or the fixing temperature is not constant when the continuous printing operation is performed; thus stable image quality cannot be guranteed.

Japanese patent Laid-open print No. 4-178679 discloses a technology by which a set value for the fixing temperature is determined by the start-up temperature of the fixing device. This technology, however, can not solve the problem due to change of environment. Japanese patent Laid-open print No. 2-161481 discloses a counter measurement to the environmental change. However, the problems such as an excess temperature rise by the temperature detection delay occur.

An object of this invention is to provide an electrophotographic apparatus with a fixing device which can maintain stable image quality regardless of the temperature change and time passage.

The present invention provides an electrophotographic apparatus having a first means for detecting the state of a fixing device before its start-up and a second means for detecting the state of the fixing device during fixing operation. The fixing voltage control means has a means for changing the control point of fixing voltage according to the temperature change and time passage by information or data of on the state of the fixing device or by the fixing voltage control characteristics.

The temperature compensation means compensates a drop of the fixing roller surface temperature per every page in such a manner that if the kind of the recording medium and the color image are fixed, the temperature decrease of the roller is changed passed on a thickness of toner. The temperature decrease by the kind of the recording medium and the frequency of the number of superposition of the color toner images is detected, then a heating means is turned on by extracting the time corresponding to the optimum heat quantity from the table stored in memory in advance.

In addition, the upper and lower limits of temperature compensation per every page are monitored. Further, temperature compensation time of every page is conducted if too low temperature is detected by monitoring the upper limit of temperature compensation of every page and means of monitoring the lower limit of temperature compensation of every page. An input quantity of heat and a taken quantity of heat are balanced by adding correction for compensation time extracted by using the temperature compensation means for every page.

The fixing voltage control means changes the control point according to the temperatures change and time passage by using the temperature characteristic of the surface temperature of the fixing roller. Therefore, the optimum fixing voltage can always be applied to the fixing roller, so that stabilization of image quality can be expected. The unstable state of the temperature at the time of starting up of the fixing device is detected before start-up. The fixing voltage control means changes the control point according to the temperature change and time passage by using the temperature characteristic of the surface temperature of the fixing roller, so that the optimum fixing voltage can be applied to the fixing roller at the time of start-up, and image quality can be stabilized.

The heat taken by the recording medium from the fixing roller is compensated by the temperature compensation means for every page; the fixing temperature that is stabilized at the time of continuous printing can be kept constant; and image quality can be maintained.

FIGS. 7*a*–7*d* are flow-charts of the control program that the control unit of this invention executes.

Figures 8, 9:
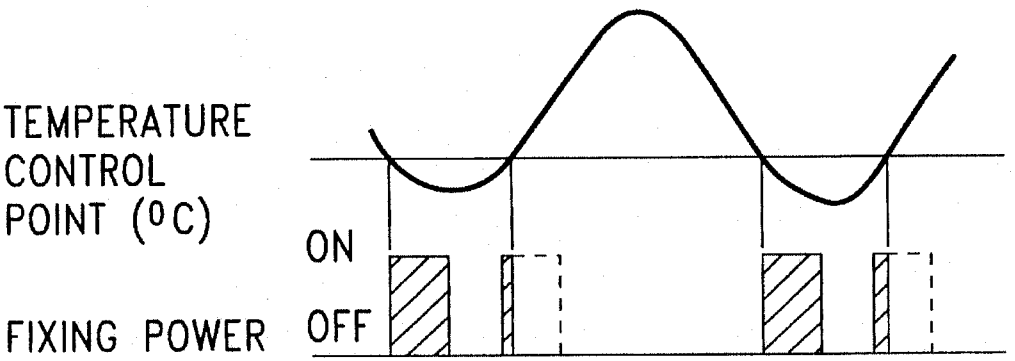

FIG. 8 is a corresponding table of the time and the control point in the control unit of this invention.

FIG. 9 is the temperature characteristic figure of the level control that the control unit of this invention executes.

Figure 10:
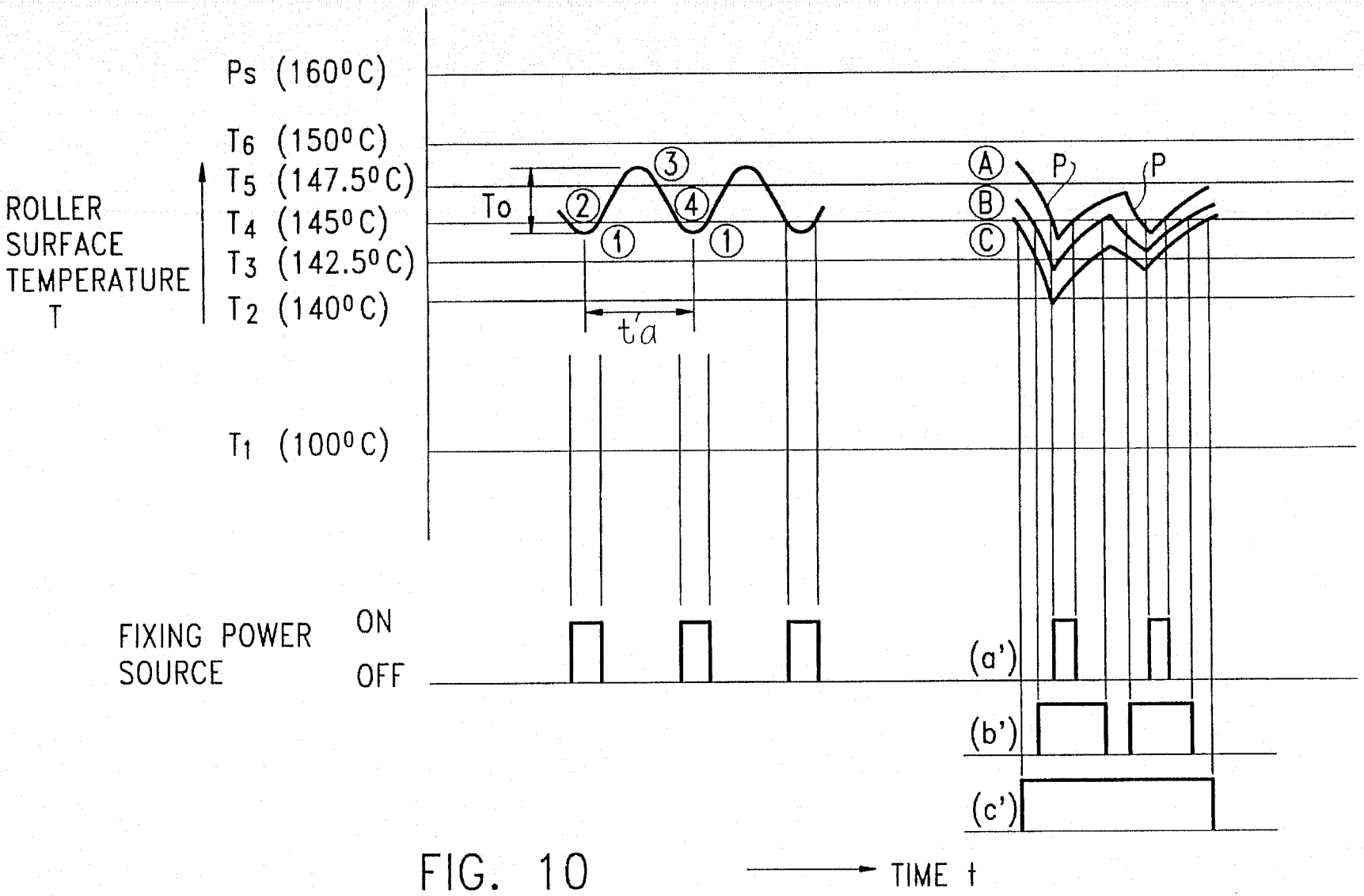

FIG. 10 is the figure that explains other examples of the temperature control method of this invention.

Figure 11:
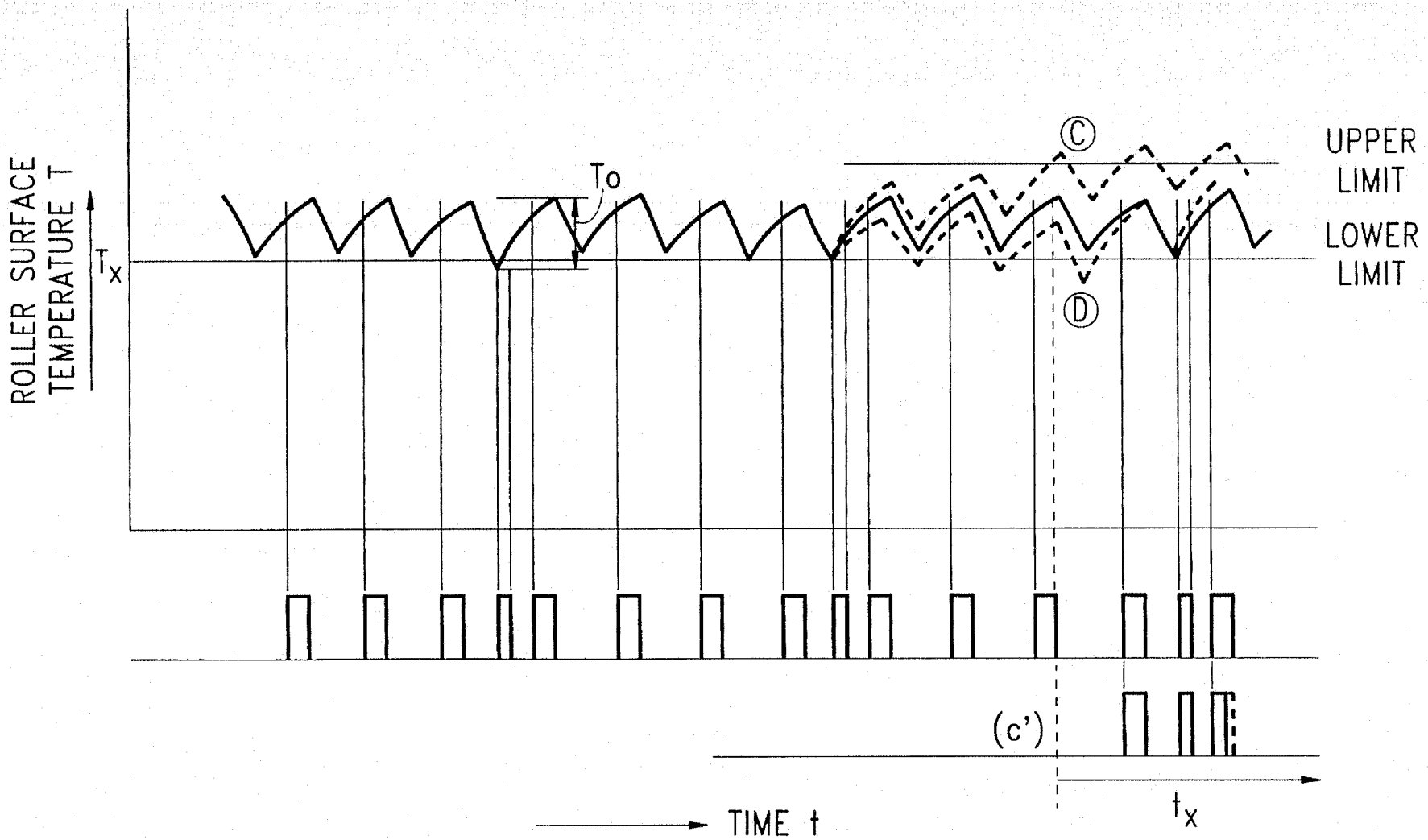

FIG. 11 shows state transition of the roller surface temperature by the method of controlling this invention.

Figure 12:
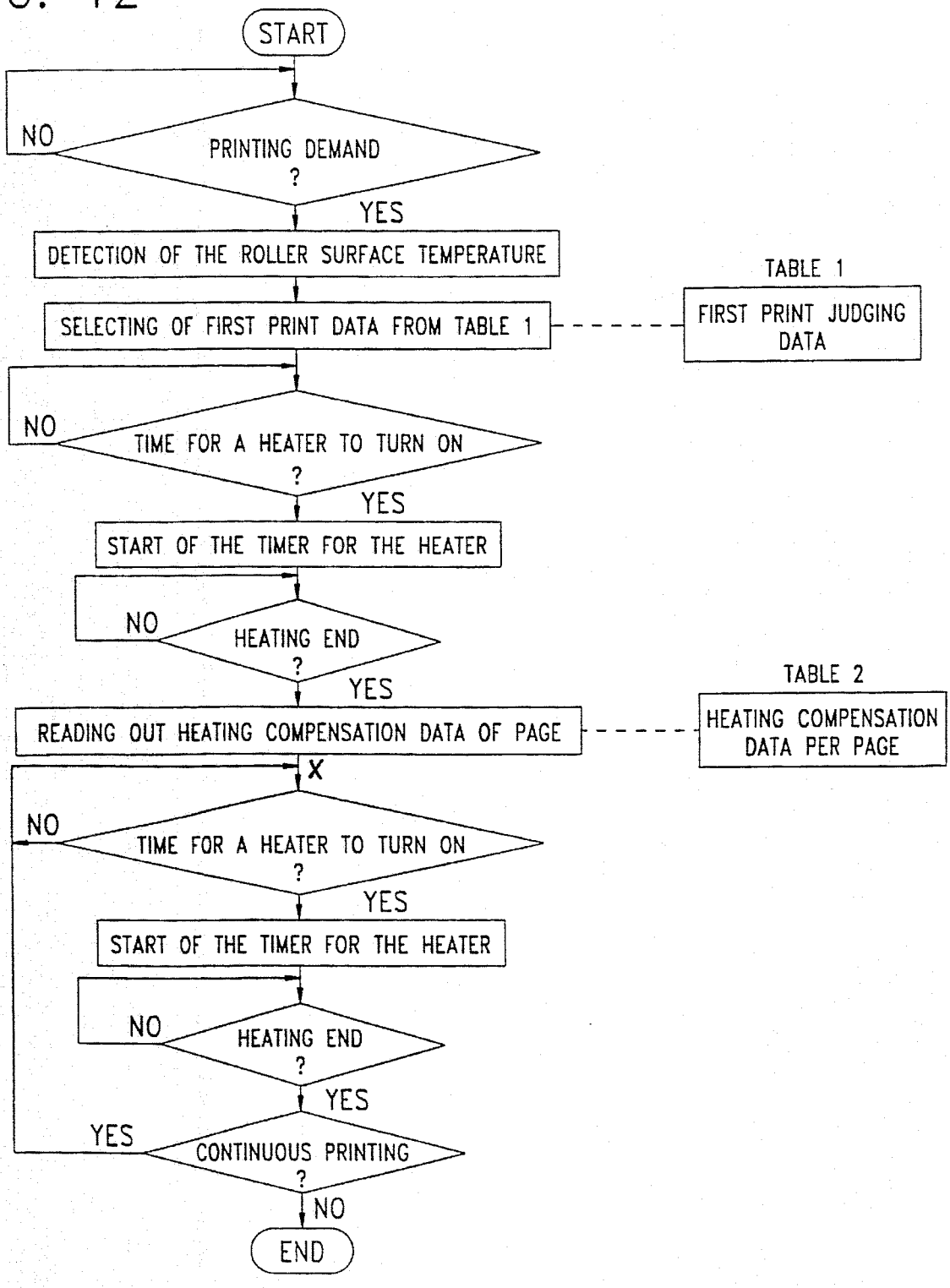

FIG. 12 is the flow-chart of the method of controlling this invention.

DESCRIPTION OF THE PREFERRED EMBODIMENTS

Figure 1:
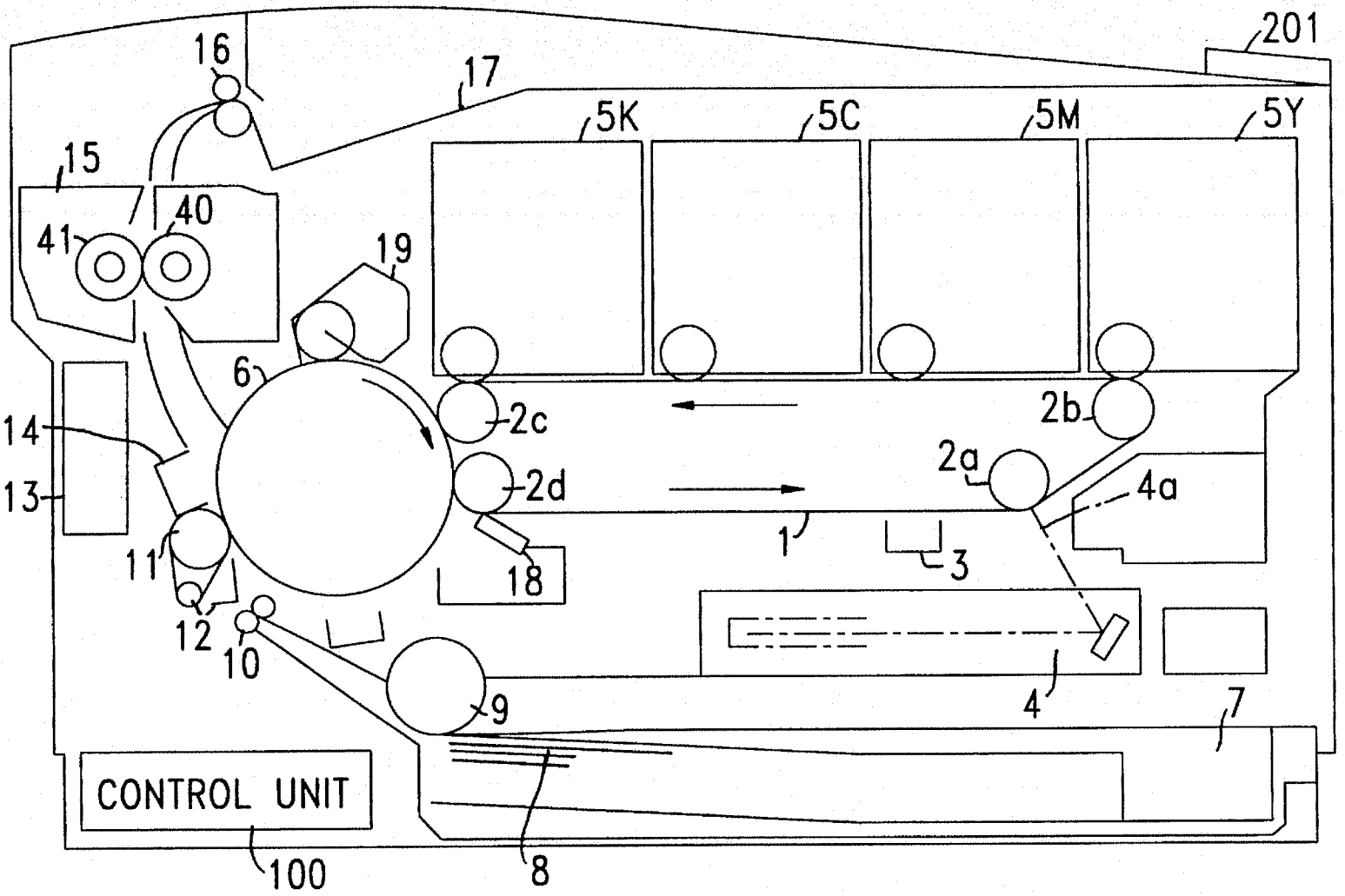
FIG. 1 is a longitudinal sectional view of the color laser printer of this invention.

Referring to the drawings, a color laser printer which is an example of the color image electrophotographic device of this invention is explained below. FIG. 1 shows a vertical sectional view of the color laser printer with the fixing apparatus of this invention. Photosensitive belt 1, coated with organic photoelectric material (OPC) on its surface, turns to arrow direction at the constant speed around the guide-rollers 2*a*–2*d*. Charger 3 gives the needed electric charge uniformly to form latent electrostatic images on the surface of photosensitive belt 1. The latent electrostatic images are formed in accordance with each color signal by being exposed to laser beam 4*a* emitted from exposure apparatus 4. The formed latent electrostatic images are developed sequentially by four developing devices of 5Y (yellow), 5M (magenta), 5C (cyanogen) and 5K (black). In this way, the toner images of monochromic colors are formed. Monochromic color for toner images on the surface of this photosensitive belt 1 become the color toner image on the surface of transfer drum 6 by piling and transferring them to the surface of the transfer drum 6 that touches and turns synchronously on the surface of the photosensitive belt 1.

Paper 8 of recording medium accumulated in a feeding paper cassette 7 is sent to resist roller 10, extracted, and transferred by paper feeding roller 9. Paper 8 is sent to transfer roller 11, after rearrangement of paper and matching and controlling the color toner image and transfer-timing on the surface of transfer drum 6. Touching transfer drum 6 with transfer roller 11, paper 8 is mechanically pressed and the transfer electric field voltage is given from the rear. In that way, the color toner images on the surface of transfer drum 6 is transferred to paper 8. Transfer roller 11 is pulled up by transfer roller separator-contactor 12 so as not to work in the process of forming color toner image. Transfer roller 11 is pushed down to transfer drum 6 by transfer roller separator-contactor 12 so as to work in the process of transferring the completed color toner image to paper 8.

Alternating voltage is given to AC discharger 14 to generate the alternating current corona voltage. AC discharger 14 neutralizes the remaining electric charge in the rear of paper 8 to which the color toner image is transferred so as to easily exfoliate paper 8, from transfer drum 6. Paper 8 exfoliated from transfer drum 6, is sent to fixing roller 40 and compression roller 41.

Figure 2:
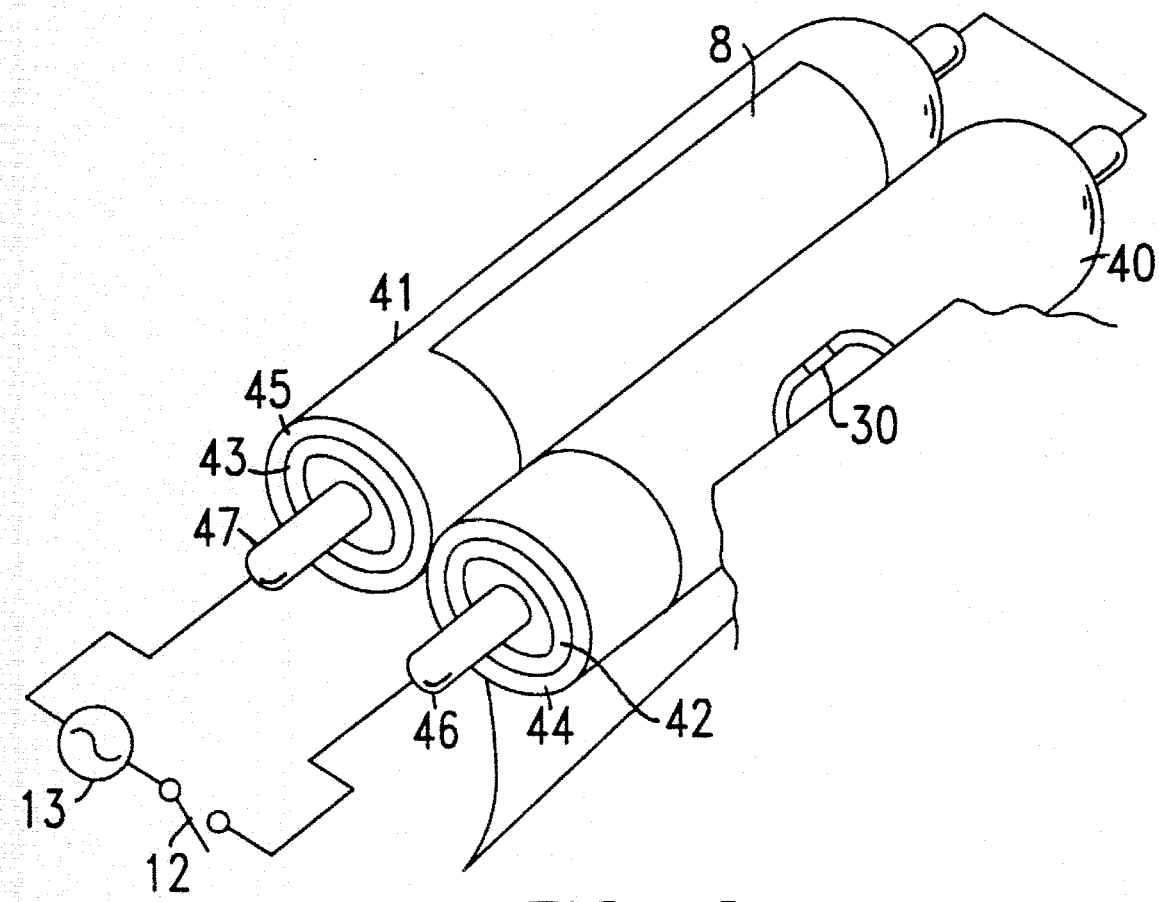
FIG. 2 is a block diagram of the fixing apparatus of this invention.

The outline structure of said fixing apparatus is explained by using FIG. 2.

Fixing roller 40 has a layer of silicone rubber 44 on aluminum pipe 42. The aluminum drum is provided with heating means 46 at the axis portion. Compression roller 41 also has a layer of silicone rubber 45 on aluminum pipe 43. The aluminum pipe is provided with heating means 47 in the same way. Non-contact type heat detection means (thermistor) 30 is provided on the surface of fixing roller 40.

This fixing roller 40 and compression roller 41 compose a part of fixing apparatus 15. Paper 8 passes between fixing roller 40 and compression roller 41 to fix the color toner image by heat on the surface of paper 8. The fixing voltage given to heat fixing roller 40 is supplied from power source 13 in response to input signals. Paper 8 on color toner image that was fixed by heat is discharged to discharging tray 17 via discharging roller 16. After transferring the toner image on photosensitive belt i to the transfer drum, belt cleaner 18 cleans off the toner remaining on the surface of photosensitive medium 1. While monochromic toner images are transferred repeatedly to the surface of transfer drum 6, drum cleaner 19 is pulled up so that the cleaning action does not operate in the process of forming the color toner image. Drum cleaner 19 is pushed down to work on the surface of transfer drum 6 after transferring the completed color toner image to paper 8.

Then, control unit 100 controls each means mentioned above according to the input signal from operation panel 201 and the information processing apparatus which is mentioned later.

Figure 3A:
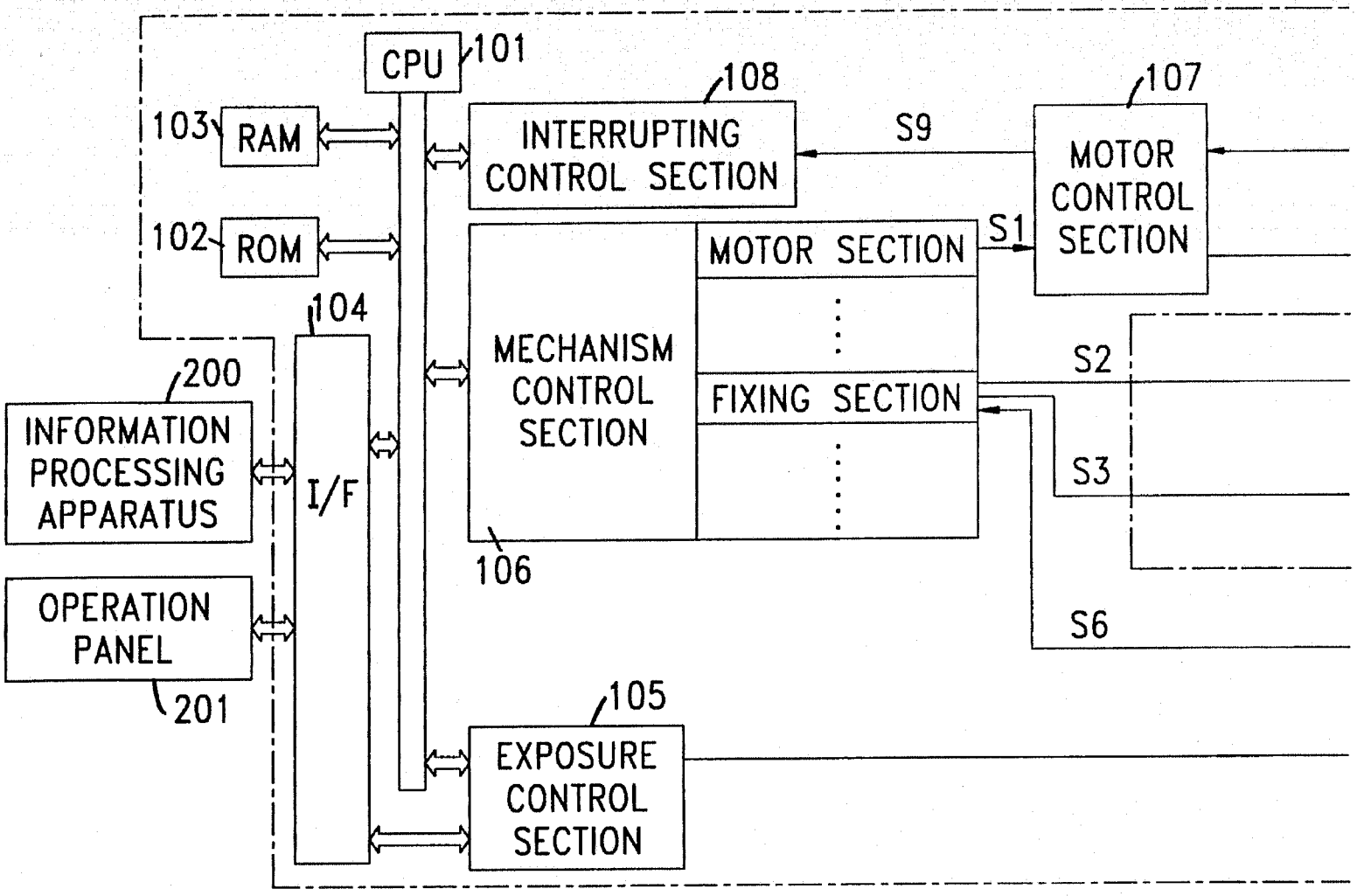
FIG. 3 is a block diagram that shows the details of the control unit in the color laser printer of this invention.
Figure 3B:
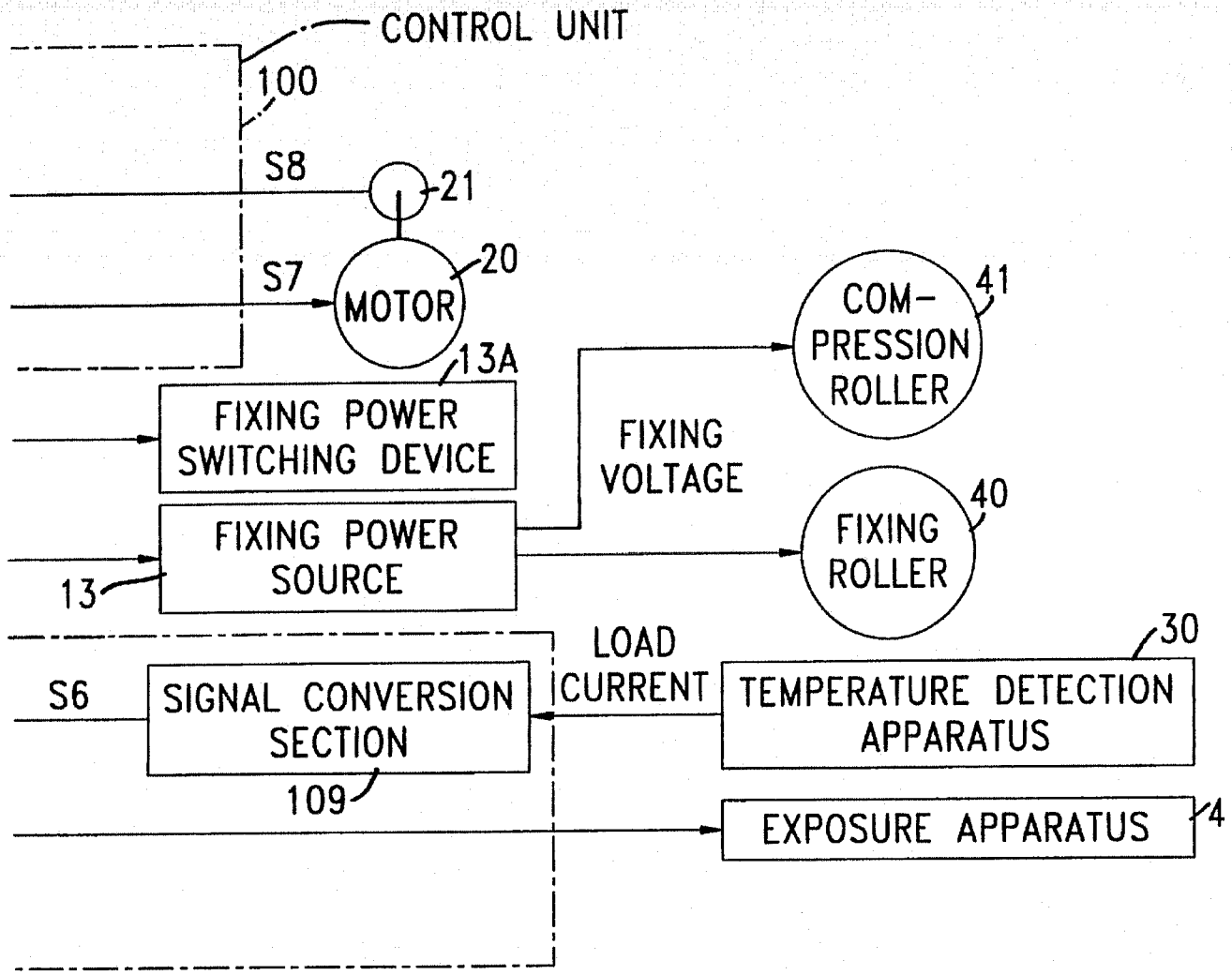

FIG. 3 is the block diagram showing the details of control unit 100 of the color laser printer. Control unit 100 is mainly composed of CPU 101, ROM 102 which stores the control program of CPU 101, and RAM 103 for work memory which is necessary for executing the control program by CPU 101.

In input-output interface (I/F) 104, CPU 101 mediates to communicate with information processing apparatus 200 such as operation panel 201, word processor and personal computer, etc. Input-output interface (I/F) 104 transfers printing data generated by information processing apparatus 200 to exposure control section 105. Exposure control section 105 generates laser beam 4*a* by controlling exposure apparatus 4.

Mechanism control section 106 is a group of control mechanisms of the printing process. CPU 101 controls mechanism control section 106 and outputs motor drive instruction signal S1, power source on/off signal S2 that drives and fixing power SW switching device 13*a*, fixing voltage control signal S3 that controls the voltage generated by power source 13. Then characteristic detection signal S6 that measured electric characteristics by the temperature detection apparatus is input.

Motor control section 107 is connected to control motor 20 which drives photosensitive belt 1, paper feeding roller 9, fixing apparatus 15, etc. Motor control section 107 generates drive signal S7 according to motor drive instruction signal S1 that is given from mechanism control section 106, and inputs detection signal S8 to detect angular displacement that occurs from encoder 21 connected directly to the rotation axis of motor 20. Motor control section 107 transfers to CPU 101 detection signal S8 of encoder 21 as rotation angle signal S9 of photosensitive belt 1 through interruption control section 108.

Figure 4:
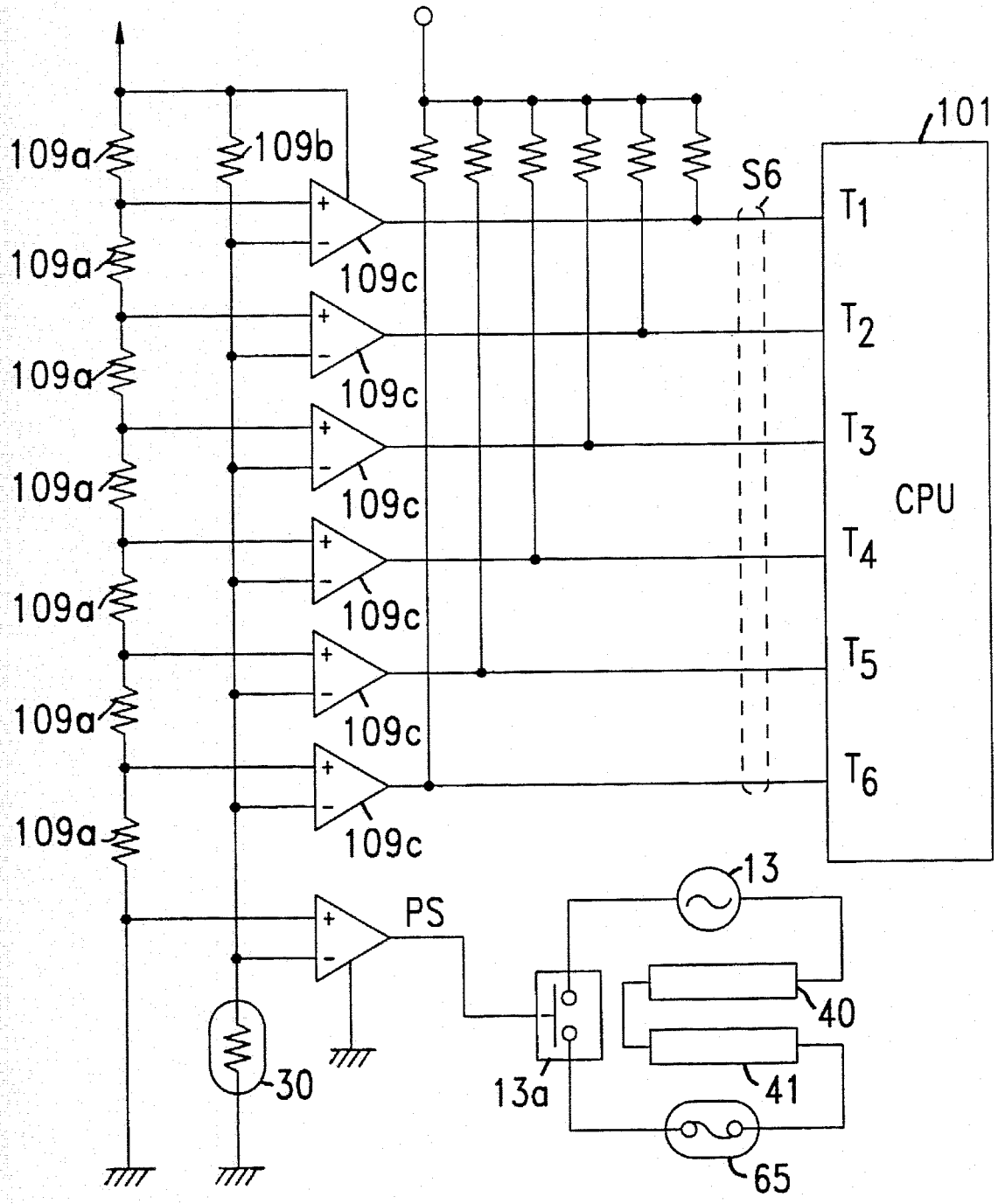
FIG. 4 is a block diagram that shows the details of the signal conversion part in the control unit of this invention.

The details of signal conversion section 109 are shown in FIG. 4. Signal conversion section 109 is provided with conversion resistances 109*a*, divided voltage resistance 109*b* and comparators 109*c*. Conversion resistances 109*a* transform the load current from temperature detection apparatus 30 that detects the temperature of fixing roller 40 into the voltage signal. Conversion resistances 109*a* are variable resistors. Divided voltage resistance 109*b* generates the comparison standard voltage group to convert an analog voltage signal to digital signal. Comparators 109*c* output characteristic detection signal S6 by comparing voltage signals and comparison standard voltages. For example, comparators 109*c* evaluate and output T1–T6 and PS for setting temperature signals.

CPU 101 receives through mechanism control section 106 characteristic detection signal and calculates an optimum fixing voltage in accordance with characteristic detection signal S6. Then, CPU 101 generates fixing voltage S3 for generating optimum voltage signal by means of mechanism control section 106.

Figure 5:
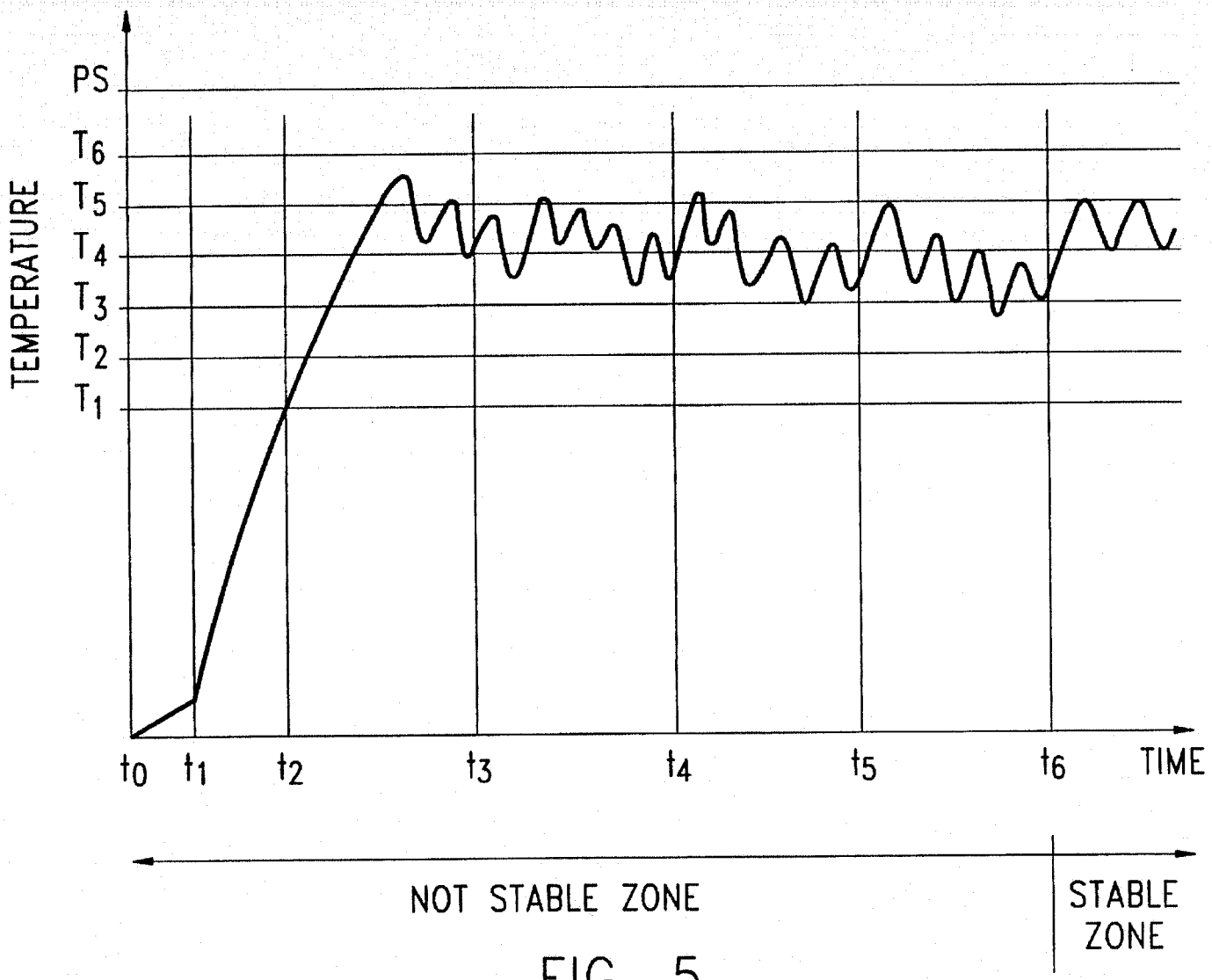
FIG. 5 is a time chart that the control unit of this invention executes.
Figure 6:
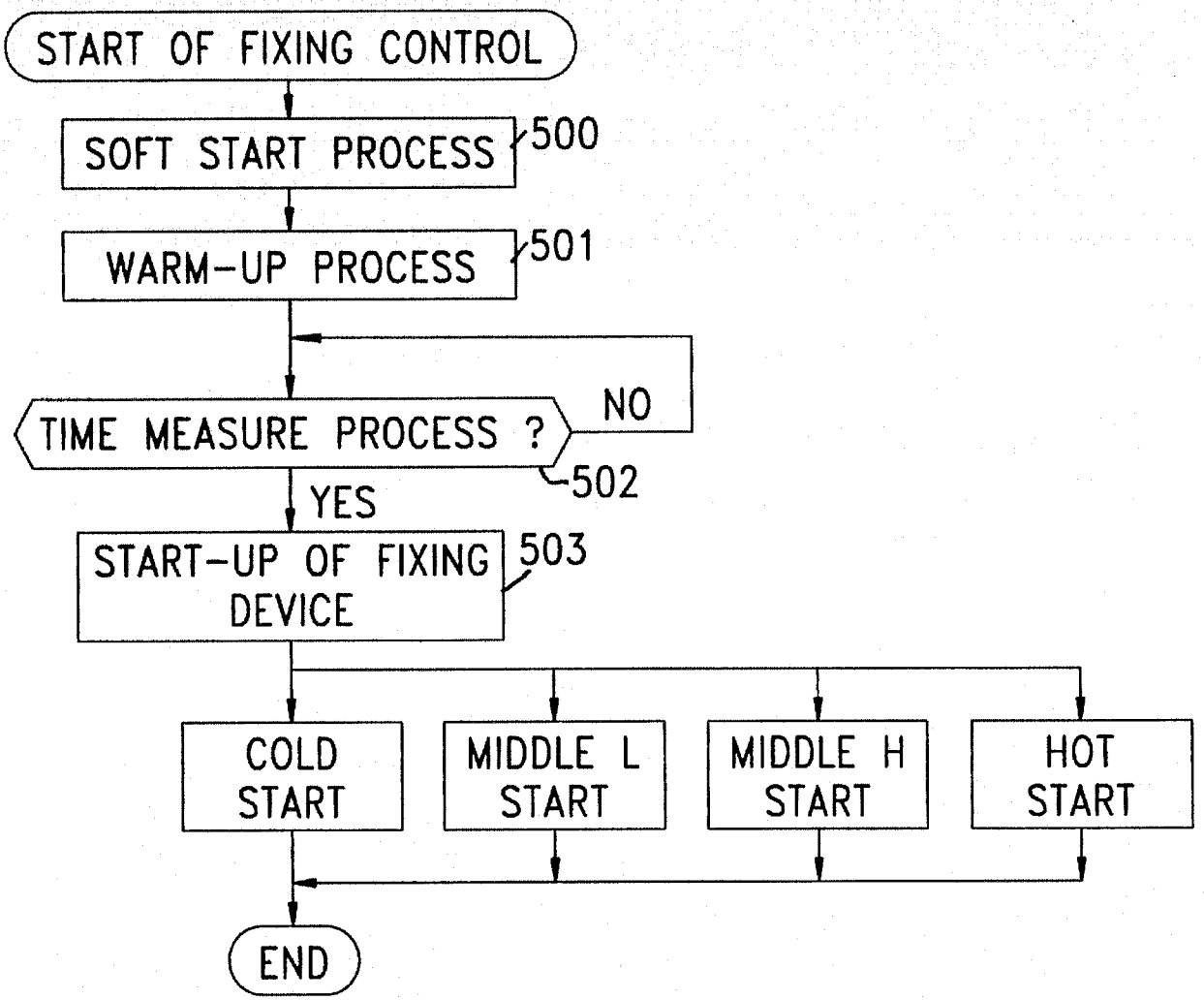
FIG. 6 is a flow-chart of the control program that the control unit of this invention executes.
Figure 7A:
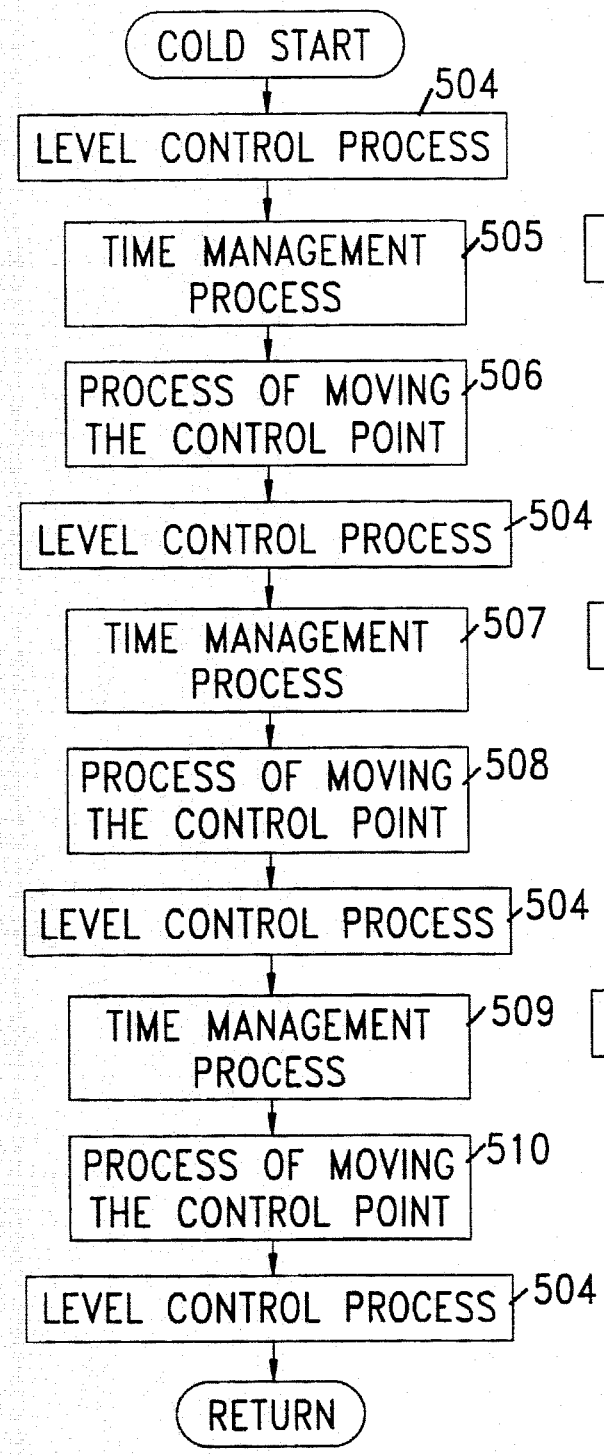
Figure 7B:
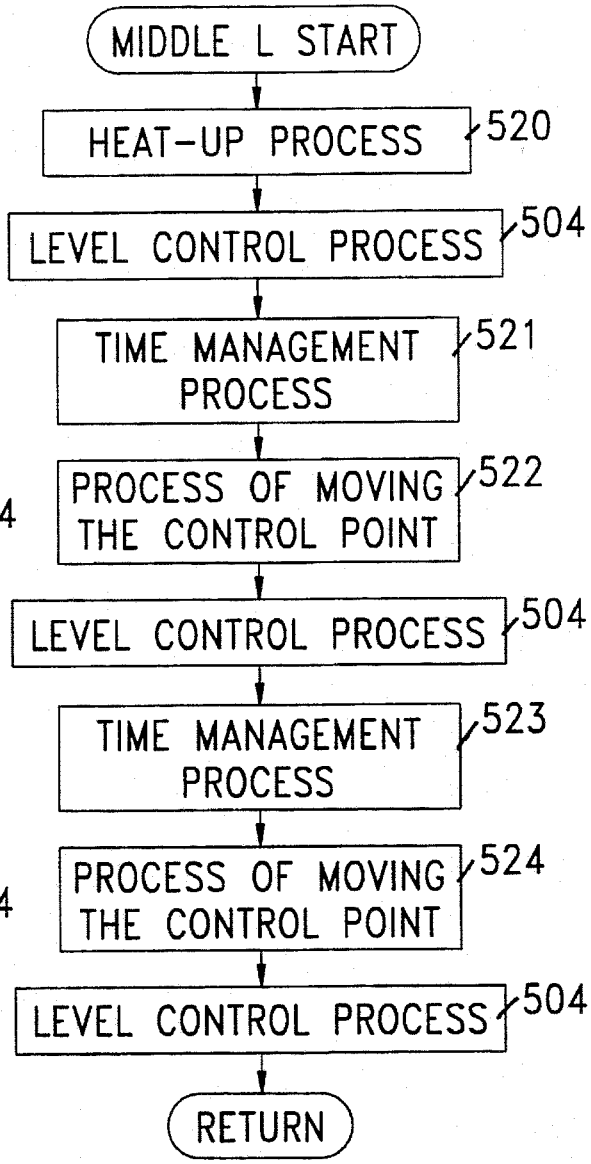
Figure 7C:
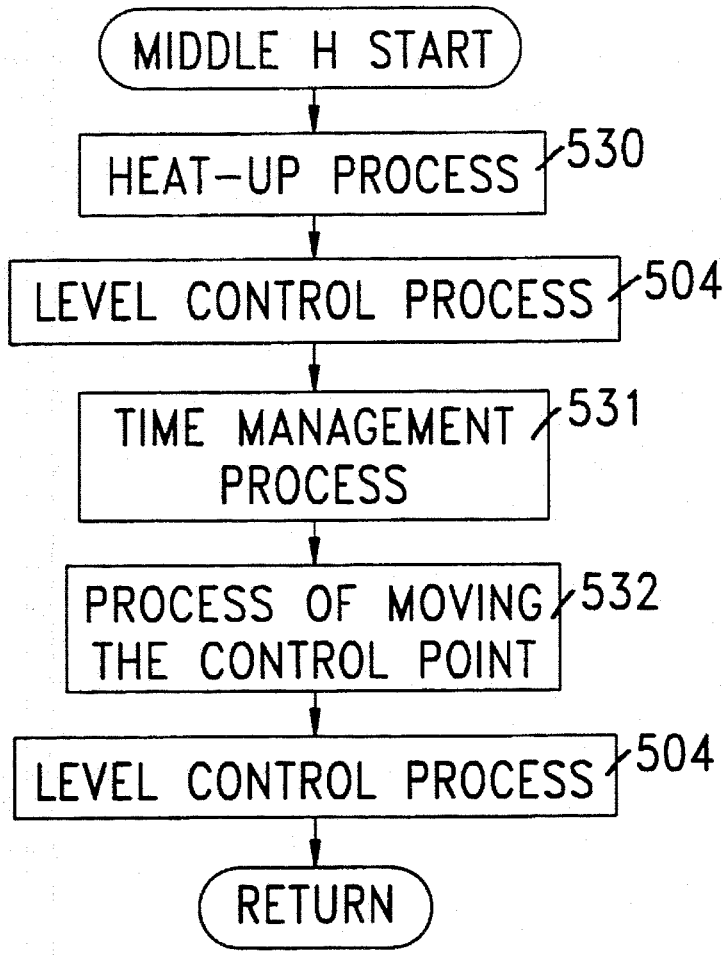
Figure 7D:
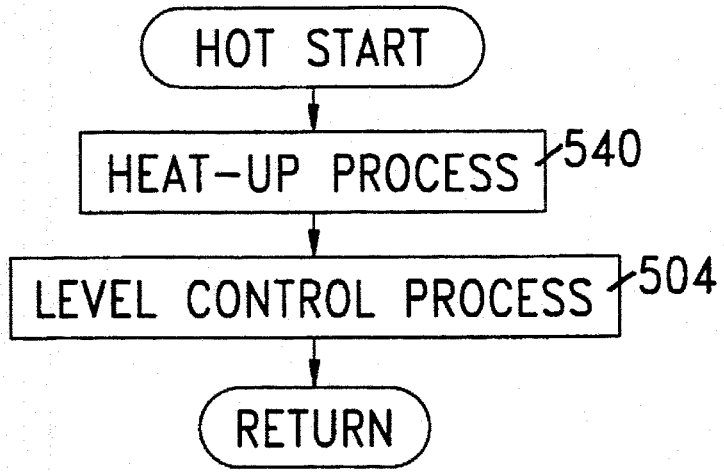

The fixing control of this color laser printer is explained by way of the time chart of FIG. 5 and the flow-charts of FIG. 6 and FIG. 7.

After printer power is on, fixing control starts. During timing t0–t1 soft starting process 500 for duty controlling the fixing voltage is conducted to alleviate the voltage change bey the rush current.

At timing t1, fixing voltage is risen by soft start and warm-up process 501 of heating fixing rolls to first setting temperature T1. Time needed to reach T1 is calculated by process 502.

State prediction control process 503 before the power start is done at timing t2. As shown in FIG. 8, the state before the power start is predicted in the process 503 from the time attaining the first setting temperature T1 from the power start. For example, cold starting is employed in case of ordinary power start and the usage in cold places, etc. Middle starting is employed in case of the usage in warm places, etc. Hot starting is employed in the case where use of the printer is resumed soon after the power is off. The beginning control point is determined according to the predicted state. A temperature drop in an unstable zone that is the time from the start of the fixing device to the stable zone of the fixing device is compensated by controlling heating time and a control point is properly shifted. The flow-chart about that is shown in FIGS. *7a–7d*.

In case of the cold starting shown in FIG. *7a*, the first setting temperature T1 is set as the beginning control point, and level control process 504 is conducted. As shown in FIG. 9, level control 504 controls fixing power source in accordance with ON/OFF signal given to the power source, if the roller surface temperature becomes lower than a certain control point temperature. If the roller surface temperature reaches the control point temperature, the fixing power source is turned off immediately.

At timing t3 in time management process 505, control point movement process 506 is performed to move the control point to the second setting temperature T2 from first constant temperature T1. Then, level control process 504 is conducted in accordance with the second setting temperature T2 as the control point.

At timing t4 in time management process 507, control point movement process 508 is executed to move the control point to the third setting temperature T3 from second constant temperature T2. Then, level control process 504 is performed in accordance with the third setting temperature T3 as the control point.

At timing t5 in time management process 509, control point movement process 510 is executed to move the control point to the fourth setting temperature T4 from third constant temperature T3. Then, level control process 504 is performed in accordance with the fourth setting temperature T4 is set as the control point.

By moving the control points in this way, the temperature excess (overshoot) that occurs by time delay of the temperature difference on the roller surface can be reduced.

In case of the middle L starting shown in FIG. *7b*, level control process 504 is conducted in accordance with the second setting temperature T2 as the beginning control point. When roller surface temperature reaches the second setting temperature T2 from first temperature T1, heat-up process 520 is performed. Then, when it reaches the second setting temperature T2, level control process 504 is conducted.

At timing t3 in time management process 521, control point movement process 522 is executed to move the control point to the third setting temperature T3 from second constant temperature T2. Then, level control process 504 is conducted in accordance with the third setting temperature T3 as the control point.

At timing t4 in time management process 523, control point movement process 524 is executed to move the control point to the fourth setting temperature T4 from third constant temperature T3. Then, level control process 504 is performed in accordance with the fourth setting temperature T4 as the control point.

Similarly in case of middle H starting shown in FIG. *7c*, the third setting temperature T3 is set as the beginning control point, and level control process 504 is conducted. Heat-up process 530 is performed until the roller surface temperature reaches the third constant temperature T3 from the first setting temperature T1, when it reaches the third setting temperature T3, level control process 504 is performed.

At timing t3 in time management process 531, control point movement process 532 is executed to move the control point to the fourth setting temperature T4 from third constant temperature T3. Then, level control process 504 is performed in accordance with the fourth setting temperature T4 as the control point.

In case of the hot starting shown in FIG. *7d*, the fourth setting temperature T4 is set as the beginning control point, and level control process 504 is conducted. Heat-up process 540 is performed until the roller surface reaches the fourth setting temperature T4 from first temperature T1. When it reaches the fourth setting temperature T4, level control process 504 is performed. Because hot starting is a re-start of the fixing device immediately after the power-off of the fixing device fixing, roller 40 has approximately the operating temperature. There is no need of the movement of the control point.

As stated above, by predicting the states before the start of the fixing device to select the most suitable control points in respective states, image quality can be stabilization because the most proper voltage can be applied to the fixing device.

FIG. 10 explains another example of this invention.

In FIG. 10, the vertical axis shows roller surface temperature T, and the horizontal axis shows time t. This figure shows the temperature change of the stable area shown in FIG. 5 after fixing device is started. T1–T6 shows the output temperature of comparators 109*c* of FIG. 4. The waveform shown in the left side in FIG. 10 shows the change of the roller surface temperature during waiting. During waiting the heater is on/off at a certain control point (e.g. control point T4). The fixing device used in an example had an ON to ON cycle, $t_a$, of about 90 seconds during waiting, and a control width T0 of the temperature was about 3.5 degrees centigrade. Therefore, width of level controlling of T2–T6 was set to be 2.5 degrees in centigrade in the range of the control level. According to the above setting, the states of the roller surface temperature can be divided into 4 areas of (1), (2), (3) and (4) in FIG. 10, and it is possible to determine which state of the fixing device is set at the time of the print starting by surface temperature state judgement means.

Waveforms (A), (B) and (C) shown on the right side show the temperature changes of the roller surface at the time of printing page. Curve (A) shows a temperature change of the fixing roller surface when recording medium passes through the fixing device in the state (3). Curve (B) shows a temperature change of the fixing roller surface when recording medium passes through the fixing device in the state (2) or (4). Curve (C) shows a temperature change of the fixing roller surface when recording medium passes through the fixing device in the state of (1). In the case of curve (A) heater is on/off in the manner shown by (a'). Similarly, heater is on/off in the manner shown by (b') in the case of curve (B). In the case of curve (C), heater is on/off in the manner shown by (c'). The parts indicated by P in the figure are temperature drops during the time while the recording medium passes through the fixing device. According to test results, it has been elucidated that a sudden temperature drop like curve (C) results in less-stabilization of image quality. Even if a heater is previously on without control to compensate the temperature drop, stable image quality cannot be obtained. Therefore, at the time of the first print, it is necessary to compensate the temperature by adjusting heating time in accordance with the roller surface temperature during waiting. As for the heating time, experimental data can be stored in program. In the present invention, toner images with stable quality can be obtained by fixing toner images on recording media in accordance with finely divided temperature zones and detected temperatures of the roller surface.

FIG. 11 shows the temperature drop change of roller surface caused by passing of the recording medium through the fixing device. In this case, the heater of the fixing device is on prior to the passing of the recording medium to compensate heat corresponding to heat deprived by the recording medium. That is, by balancing the heat which is taken with the heat which is input, temperature change T0 can be made small. It is desirable that the surface temperature be controlled not to be beyond adjacent control points. For example, FIG. 11 illustrates an upper limit and a lower limit $T_x$ for the roller surface temperature, T. Because the quantity of heat deprived by the recording medium is varied based on the kinds of recording media and the number of superpositions of color toner images, it is necessary to change the quantity of heat input to the fixing device. Therefore, it is recommended to prepare the data table consisting of heating time, kinds of recording media and the number of superpositions. The compensation temperature zone is subdivided, and the system is composed to modify the contents of the table from outside. The temperature compensation condition also can be changed in accordance with environmental changes such environmental temperature and moisture.

Dotted waveforms (C) and (D) in FIG. 11 show the temperature changes in the case where compensation of the temperature is not appropriate. If the upper limit and the lower limit are set to the control points, it is possible to judge whether the compensation is appropriate by taking into consideration the number of occurrences that the temperature exceeds the upper limits and drops below lower limits, and the time intervals of the above temperature. For example, when the temperature goes over upper limit twice in a short time is, the heating time too long. As shown in FIG. 11, $t_x$ is the time that the temperature exceeds the upper limit. Thus the heating time should be reduced by correction. As stated above, control by a timer can be corrected by monitoring the roller surface temperature.

FIG. 12 shows a brief flow-chart of temperature control of the fixing device during the printing operation. Upon printing demand the surface temperature of the fixing roller is detected by the a surface temperature detecting means. Next, heating time is chosen from the table of first print judging data into first print judging means.

Then, the first print judging means judges whether it is time for the heater to turn on or not. When timing for the heater is on, the timer for the heater is started. When the timing is not on, the same judgement is repeated after a while.

Next, the first print judging means judges whether heating is ended or not. When the time is up, the temperature compensation per page means reads out compensation data from the temperature compensation data table. Then, the temperature compensation per page means judges whether it is heater timing or not. When timing for the heater is on, the temperature compensation per page means starts the timer of the heater.

Next, the temperature compensation per page means judges whether the heating is ended or not. When heating is over, the heater is turned off. Then the first print temperature judging means judges whether the demand is continuous printing or not. When the demand is continuous printing, the processing is repeated from point X. When the demand is not continuous printing, the fixing operation is ended.

As stated above, this invention realizes stable fixing operation by setting the temperature compensations for first print and for continuous printing separately.

In the present invention, the fixing voltage control means changes the control point of fixing temperature, roller surface temperature change and time lapse. Therefore, because the most suited fixing voltage is applied to the fixing roller stable, image quality is obtained.

What is claimed is:

1. An electrophotographic apparatus comprising:

a toner image supporting member on which a toner image developed on an electrostatic latent image is formed;

a recording medium feeder that brings the recording medium into contact with said toner image supporting member;

a fixing apparatus including:
a fixing roller; and a compression roller in contact with each other to fix the toner image on the recording medium;

a heater disposed inside at least one of said fixing roller and said compression roller;

a temperature detector coupled to the surface temperature of said fixing roller;

a state detector detecting the state of said fixing apparatus before said fixing apparatus is powered on; and a fixing voltage controller that controls a fixing voltage applied to said heater based on a temperature characteristic measured by said temperature detector, said fixing voltage controller includes a first control characteristic changing means for changing a control point of the fixing voltage by a plurality of fixing voltage control characteristics on the basis of the temperature characteristic measured by said temperature detector.

2. The electrophotographic apparatus according to in claim 1, wherein said temperature detector includes:

a sensor detecting the temperature of the surface of said fixing roller;

3. The electrophotographic apparatus according to claim 1, wherein said fixing voltage controller includes a second control characteristic changing means for changing the control point of the fixing voltage according to time of the temperature change.

4. An electrophotographic method comprising the steps of:

preparing for electrophography;

forming a toner image on a photosensitive medium;

judging a surface temperature of a fixing roller based on information detected by a temperature detector;

changing a control point of a fixing voltage based on the step of judging the surface temperature; and compensating a surface temperature drop of the fixing roller occurred by passing a recording medium through the fixing apparatus.

5. The electrophotographic method according to claim 4, further comprising:

superposing toner images each having different colors on the recording medium, to form a color image;

judging the surface temperature drop of the fixing roller for each page of the recording medium; and compensating the surface temperature drop of the fixing roller for each page of the recording medium.

6. The electrophotographic method according to claim 5, wherein step for compensating compensates the surface temperature drop of the fixing roller in accordance with the kind of recording medium and the number of color superpositions.

7. The electrophotographic method according to claim 4, wherein the surface temperature drop of the fixing roller for each page is compensated.

a plurality of variable resistors that transforms the output current of said sensor into a plurality of voltage signals; and a plurality of comparators that judges and outputs a plurality of setting temperature signals after comparing the voltage signals with a plurality of comparison standard signals.

8. The electrophotographic method according to claim 7, wherein the surface temperature of the fixing roller is controlled to a specified state by a heater.

9. An electrophotographic apparatus comprising:

a toner image supporting member on which toner images, each having a different color, developed on an electrostatic latent image are formed;

a transferring means tier transferring and superposing the toner images on said toner image supporting member to an intermediate transfer member;

a recording medium feeder that brings the said recording medium into contact with said intermediate transfer member;

a fixing apparatus including:

a fixing roller; and a compression roller in contact with each other to fix the toner images on said recording medium;

a heater disposed inside at least one of said fixing roller and said compression roller;

a temperature detector coupled to the surface of said fixing roller;

a state detection means for detecting the state of the fixing apparatus before said fixing apparatus is powered on; and a fixing voltage controller that controls a fixing voltage applied to said heater based on a temperature characteristic measured by said temperature detector, said fixing voltage controller includes a first control characteristic changing means for changing a control point of the fixing voltage by a plurality of fixing voltage control characteristics on the basis of the temperature characteristic measured by said temperature detector.'

* * * * *

UNITED STATES PATENT AND TRADEMARK OFFICE

CERTIFICATE OF CORRECTION

PATENT NO. : 5,555,074 Page 1 of 4

DATED : 10 September 1996

INVENTOR(S) : Hideyuki HARAGAKIUCHI et al.

It is certified that error appears in the above-identified patent and that said Letters Patent is hereby corrected as shown below:

| Column | Line | |
|---|---|---|
| 1 | 17 | After "than" delete ",". |
| 1 | 57 | After "thus" insert ",". |
| 2 | 1 | Insert --SUMMARY OF THE INVENTION--. |
| 2 | 12 | Before "on" delete "of". |
| 2 | 18 | Change "passed" to --based--. |
| 2 | 20 | Delete "frequency of the"; change "superposition" to --superpositions--. |
| 2 | 55 | Insert: --BRIEF DESCRIPTION OF THE DRAWINGS--. |
| 3 | 15 | Before "DESCRIPTION" insert --BRIEF--; delete "OF THE PREFERRED". |
| 3 | 16 | Delete "EMBODIMENTS". |
| 3 | 24 | Before "arrow" insert --an--. |

UNITED STATES PATENT AND TRADEMARK OFFICE

CERTIFICATE OF CORRECTION

PATENT NO. : 5,555,074

DATED : 10 September 1996

INVENTOR(S) : Hideyuki HARAGAKIUCHI et al.

It is certified that error appears in the above-identified patent and that said Letters Patent is hereby corrected as shown below:

| Column | Line | Corrections |
|---|---|---|
| 3 | 49 | After "drum 6" change "is" to --are--. |
| 4 | 13 | Change "i" to --1--. |
| 4 | 45 | After "drives" delete "and"; after "13a" insert --and--. |
| 5 | 20 | Change "bey" to --by--. |
| 5 | 21 | Change "risen" to --raised--. |
| 5 | 67 | Delete "is". |
| 7 | 15 | After "(A)" insert --,--. |
| 7 | 39 | Change "deprived" to --absorbed--. |
| 7 | 46 | Change "deprived" to --absorbed--. |
| 7 | 56 | After "such" insert --as--. |
| 7 | 63 | Change "that" to --by which--. |

UNITED STATES PATENT AND TRADEMARK OFFICE

CERTIFICATE OF CORRECTION

PATENT NO. : 5,555,074

DATED : 10 September 1996

INVENTOR(S) : Hideyuki HARAGAKIUCHI et al.

It is certified that error appears in the above-identified patent and that said Letters Patent is hereby corrected as shown below:

| Column | Line | |
|---|---|---|
| 7 | 67 | After "short time" delete "is"; after "heating time" insert --is--. |
| 8 | 37 | Change "suited" to --suitable--; after "roller" insert --,--. |
| 8 | 38 | After "stable" delete ",". |
| 8 | 66 | After "according to" delete "in". |
| 9 | 2 | Start new paragraph and insert: --a plurality of variable resistors that transforms the output current of said sensor into a plurality of voltage signals; and |

UNITED STATES PATENT AND TRADEMARK OFFICE

CERTIFICATE OF CORRECTION

PATENT NO. : 5,555,074 Page 4 of 4

DATED : 10 September 1996

INVENTOR(S) : Hideyuki HARAGAKIUCHI et al.

It is certified that error appears in the above-identified patent and that said Letters Patent is hereby corrected as shown below:

| Column | Line | |
|---|---|---|
| 9 | 2 | (continued) --a plurality of comparators that judges and outputs a plurality of setting temperature signals after comparing the voltage signals with a plurality of comparison standard signals.--. |
| 9 | 29 | After "wherein" insert --the--. |
| 9 | 36-38 | Delete. |
| 10 | 1-4 | Delete. |
| 10 | 12 | Change "tier" to --for--. |

Signed and Sealed this

Twenty-ninth Day of April, 1997

Bruce Lehman

*Attest:*

BRUCE LEHMAN

*Attesting Officer*

*Commissioner of Patents and Trademarks*